US008529122B2

(12) United States Patent
Cettour-Baron et al.

(10) Patent No.: US 8,529,122 B2
(45) Date of Patent: Sep. 10, 2013

(54) SWISS LEVER ESCAPEMENT

(75) Inventors: Raphael Cettour-Baron, Messery (FR); Alexandre Chiuve, Grand-Lancy (CH)

(73) Assignee: Rolex S. A., Geneva (CH)

( * ) Notice: Subject to any disclaimer, the term of this patent is extended or adjusted under 35 U.S.C. 154(b) by 386 days.

(21) Appl. No.: 12/963,143

(22) Filed: Dec. 8, 2010

(65) Prior Publication Data

US 2011/0149696 A1 Jun. 23, 2011

(30) Foreign Application Priority Data

Dec. 21, 2009 (CH) ..... 1959/09

(51) Int. Cl.
*G04B 15/14* (2006.01)

(52) U.S. Cl.
USPC ..... 368/131; 368/130

(58) Field of Classification Search
USPC ..... 368/132, 133
See application file for complete search history.

(56) References Cited

U.S. PATENT DOCUMENTS 3,628,327 A * 12/1971 Abe ..... 368/124
4,041,693 A * 8/1977 Bonsack ..... 368/124
7,731,415 B2 * 6/2010 Conus et al. ..... 368/131

* cited by examiner

*Primary Examiner* — Renee Luebke
*Assistant Examiner* — Jason Collins
(74) *Attorney, Agent, or Firm* — Westerman, Hattori, Daniels & Adrian, LLP

(57) ABSTRACT

This Swiss lever escapement comprises an escape wheel having teeth, and a lever having on the one hand an entry pallet and an exit pallet that engage alternately with the teeth of the escape wheel, and on the other hand a fork that engages periodically with an impulse pin on a roller mounted on the staff of a regulator balance wheel. The relative width Lpl of each of said pallets, expressed as a percentage of the sum of the lengths of arc of one of said teeth and one of said pallets, measured at the circumference of the escape wheel is:

$$Lpl = \frac{Ls}{Ls + d} \text{ or } \frac{Le}{Le + d} \leq 60\%$$

where Ls and Le are the lengths of arc of the exit pallet and entry pallet, respectively, and
d is the length of arc of one escape wheel tooth.

20 Claims, 3 Drawing Sheets

SWISS LEVER ESCAPEMENT

This invention relates to a Swiss lever escapement comprising an escape wheel having teeth, and a lever having on the one hand an entry pallet and an exit pallet that engage alternately with the teeth of the escape wheel, and on the other hand a fork that engages periodically with an impulse pin on a roller mounted on the staff of a regulator balance wheel.

The Swiss lever type of escapement consists of a lever pivoted on an arbor, and an escape wheel fixed to an escape pinion. The teeth of the wheel and the pallets of the lever with which they are alternately in contact are the points of connection between the wheel and the lever. The dart, projecting from between the horns of the fork at the opposite end of the stem of the lever from the pallets, prevents any shaking of the lever while the balance wheel is moving freely through an additional arc, until the next passage of the impulse pin of the balance wheel roller between the horns of the fork.

The operation of the Swiss lever escapement can be divided into four distinct parts:

- the unlocking of an escape wheel tooth bearing against the draw face (or rest plane) of one of the pallets,
- the impulse A caused by the sliding of the edge of one of the escape wheel teeth against the impulse plane of one of the pallets,
- the impulse B caused by the sliding of the edge of one of the pallets against the impulse plane of one of the escape wheel teeth,
- the drop of a tooth onto the draw face of the other pallet.

Unlocking occurs when the balance wheel comes into contact in the fork of the anchor. This unlocking causes a slight recoil of the escape wheel which depends on the draw angle of the pallet, so this phase is energy-consuming for the balance wheel. The energy used to release the lever corresponds to a safety which makes it possible to keep the lever in one of its two stable positions.

Once the entry pallet is unlocked, during the first impulse phase, the edge of the tooth of the escape wheel is pushed by the torque supplied by the mainspring through the gear train against the impulse plane of the entry pallet, producing a torque about the pivot axis of the lever. This torque puts the fork in contact with the impulse pin of the balance wheel roller and begins the transmission of energy to the balance wheel. This impulse is impulse A.

Next, the edge of the escape wheel tooth comes off the impulse plane of the pallet, and it is then the edge of the pallet that makes contact with the impulse plane of the tooth at the escape wheel. This is the second phase of transmission of energy corresponding to impulse B.

Finally, when the escape wheel tooth comes off the entry pallet of the lever, the escape wheel, subjected to only the torque of the main spring, is stopped by the rest or draw face of the exit pallet, which corresponds to the drop.

At this point, the value of the locking of the exit pallet is known as virtual locking. The phase that follows, known as the draw, is the result of the combined action of the force applied by the escape wheel tooth to the draw face of the pallet, and the orientation of this face with respect to the pivot axis of the lever, known as the draw angle. The lever thus regains its second stable position and marks the end of the entry function.

At this stage, corresponding to a half-oscillation of the balance wheel, the locking of the pallet is said to be total. One half-oscillation later, the same scenario occurs again, symmetrically, for the exit function.

L. Defossez's *La Théorie Générale de l'Horlogerie* [The General Theory of Horology] (1952, La Chambre Suisse de l'Horlogerie) details the different types of escapement, including free lever escapements. If the tooth of the wheel and the lever each have an impulse plane the escapement has a shared impulse surface, the typical example of which is the Swiss lever escapement. An escapement with shared impulse surfaces is clearly the most reliable for a wrist watch. In all the cases mentioned by Defossez, the impulse planes of the lever pallets are longer than those of the escape wheel teeth.

This opinion is confirmed and even amplified by EP 1892589, which recommends pallets even wider than in standard Swiss lever escapements. In that document, the arc occupied by the pallets, particularly by the exit pallet Ls, is >6.5°, and the ratio of the angles described by the exit and entry pallets Ls, Le to one of the escape wheel teeth is Ls/d>2.5.

U.S. Pat. No. 3,628,327 discloses a Swiss lever escapement in which the length of the impulse plane of the lever pallets is less than that of the escape wheel teeth. This gives better efficiency of 49% for an escapement operation at 4 Hz, as compared with 43% for a standard Swiss lever escapement. The ratio of the respective lengths of the impulse plane Lg of one of the escape wheel teeth to the impulse plane La of one of the lever pallets is between 1:1 and 2:1. The length of the impulse planes of the pallets is still greater than 200 μm.

Seeing the two approaches mentioned above, diametrically different but both aimed at the same goal of increasing the efficiency of the Swiss escapement, it seemed worthwhile to consider whether there might not be another way of achieving even better efficiency and to see what is or are the parameters that would need modifying to achieve this result.

The object of the present invention is to improve the efficiency of a Swiss lever escapement, as compared with, among others, the solutions recommended in the prior art.

To this end, this invention relates to a Swiss lever escapement as claimed in claim 1.

Practical tests on escapements made in accordance with the subject of the present invention have shown that it is possible to improve their efficiency as compared with, among others, the results obtained with prior art escapements.

The accompanying drawings show, schematically and by way of example, two embodiments of the Swiss lever escapement of the present invention.

Figure 3:
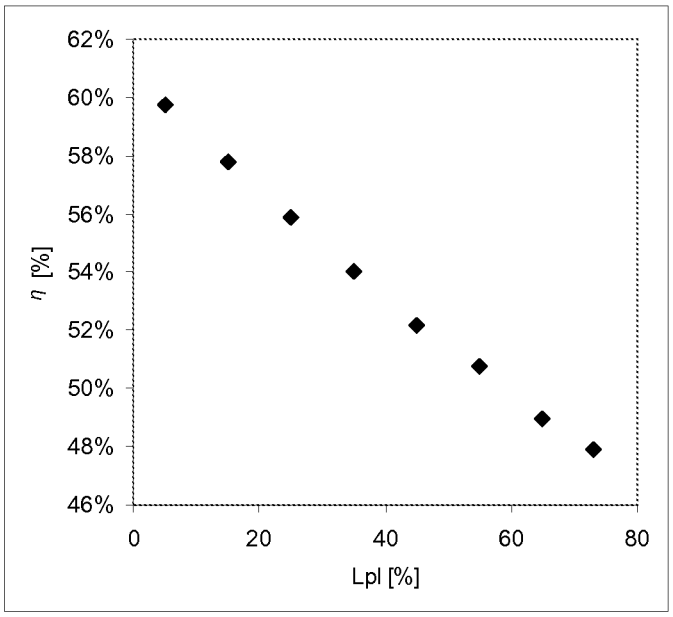
Figure 4:
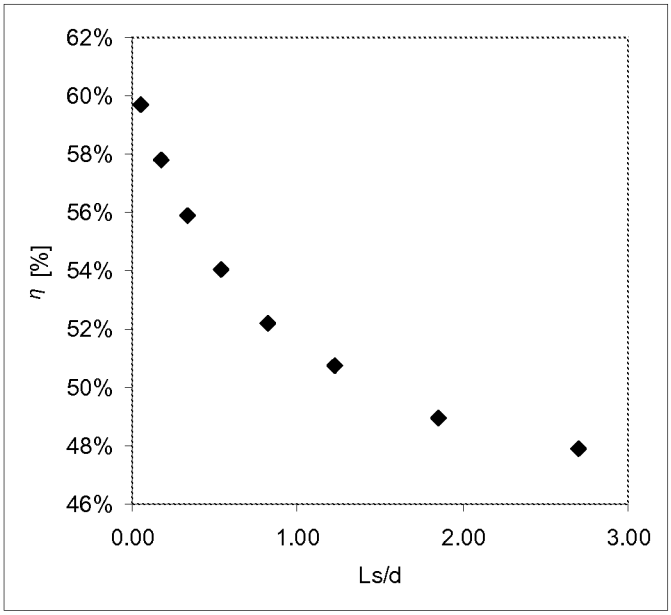
Figure 5:
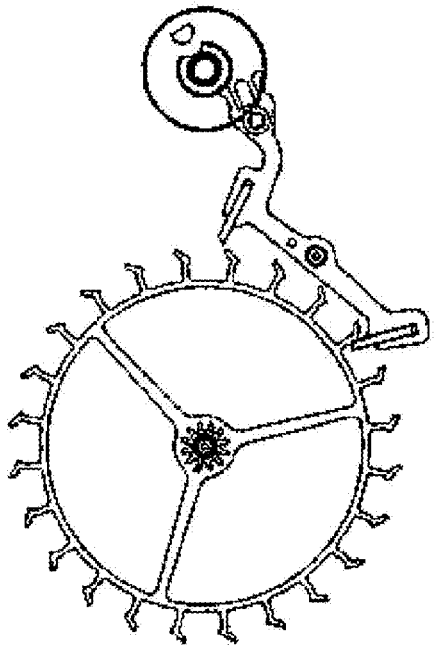

FIGS. 3 and 4 are diagrams of the efficiency η of the escapement plotted against various parameters for escape wheels having 24 teeth and a center spacing (the distance between the balance wheel axis and the escape wheel axis) of 3.0 mm (see also table 2); and FIG. 5 is a plan view of an embodiment of the escapement of the invention.

Figure 1:
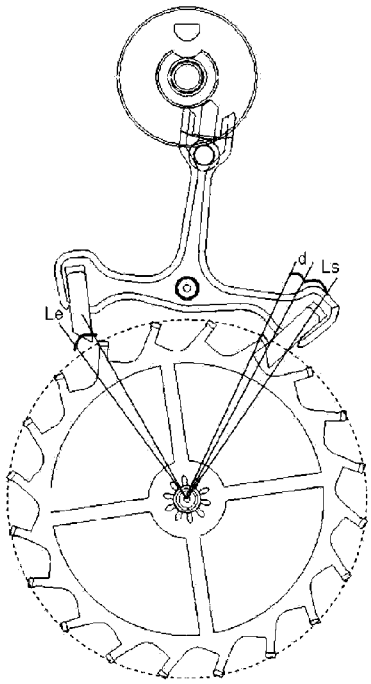
FIG. 1 is a plan view of a standard Swiss lever escapement, showing the various parameters involved in improving its efficiency.
Figure 2:
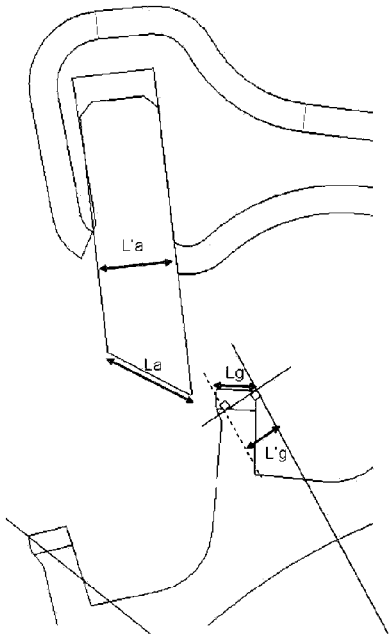
FIG. 2 is a partial view, on a larger scale, of FIG. 1.

The table that follows gives the definition of the various parameters used in the course of the following description. These parameters are indicated in FIGS. 1 and 2.

| | |
|---|---|
| Ls/Le | Angle measured at the circumference of the escape wheel and travelled by the edge of an escape wheel tooth in contact with the exit (or entry) pallet between its rest position and the end of its contact with this pallet [°] |
| d | Angle measured at the circumference of the escape wheel, occupied by the impulse plane of one of the teeth at the escape wheel [°] |
| La | Length of the impulse plane of the pallet [μm] |
| Lg | Length of the impulse plane of an escape wheel tooth [μm] |
| L'a | Width of the pallet [μm] |

-continued

| | |
|---|---|
| L'g | Width of the tooth, characterized by the projection of the plane of the tooth onto the normal to the radius passing through the impulse nose of this tooth [μm] |
| Lpl | Relative width of one of the pallets, expressed as a percentage of the sum of the lengths of arc of a tooth and of this pallet. $Lpl = \frac{Ls}{Ls + d}$ or $\frac{Le}{Le + d}$ |

The complete architecture of a Swiss lever escapement can be defined by a certain number of parameters. Before these parameters can be varied and the system studied, the functional diagram of the escapement must be established. This is a known process described in the literature, as for example in *La Théorie Générale de l'Horlogerie* by L. Defossez.

Careful study shows that the parameter Lpl, the relative width of the pallets, expressed as a percentage of the sum of the lengths of arc of a tooth and a pallet, and equal to $$Lpl = \frac{Ls}{Ls + d}$$

for the exit pallet and $$Lpl = \frac{Le}{Le + d}$$

for the entry pallet, is influential. This width must be minimized, as shown in the diagram, FIG. 3, because efficiency decreases with this value over the range considered. The other parameters are already close to the optimal values, or even have these optimal values, or have relatively little influence.

The relative decrease in the width of the pallet is accompanied by an increase in the width of the escape wheel tooth in order to conserve the same angular sector of transmission of energy and make the best use of it. As a result, two modes of energy transmission are distinguished, impulse A when the edge of the tooth is moving over the impulse plane of the pallet and exerting a thrust, and impulse B when the impulse plane of the tooth is moving relative to the edge of the pallet and exerting a thrust.

FIG. 3 shows this dependency clearly. It can be seen that the use of narrow pallets (the length of the impulse plane is less than 200 μm) produces greater efficiency than that given in U.S. Pat. No. 3,628,327 (which is 49%, as compared with more than 51% in the present case).

All the examples are given here with an identical width for both the entry and exit pallets, but obviously there may be reasons to vary the dimensions of the entry and exit pallets.

The number of teeth of the escape wheel has little influence on the escapement's efficiency, and can vary over a wide range (for example from 16 to 30 teeth). The angle formed by the line at the centers (the lines connecting the centers of the axes of the balance wheel, lever and escape wheel) has no significant influence on the efficiency of the escapement.

Advantageously, the ratio of the lift angle of the balance wheel to that of the escape wheel (the angle formed by the lever stem between the two stable positions of the lever), which in the Swiss lever escapement is typically 3.6:1, is in the present invention from 3.7:1 to 7:1, preferably 4.5:1.

With this study as a guide, and bearing in mind the various constraints mentioned, the following geometries were produced with the aim of manufacturing a series of prototypes and comparing the calculations with the measurements.

FIG. 5 shows an embodiment of a Swiss lever escapement according to the present invention. Its parameters correspond to reference 2 in table 2 below. This escapement has a 24-tooth escape wheel. The lever is made of Ni by the Liga process with 0.125-mm thick pallets made conventionally of ruby. For the wheel, two configurations are tested, one wheel made of Ni with a plate of 0.13 mm and a second wheel made of Si with a plate of 0.15 mm. Other materials can of course be used, for the lever, the lever pallets, and the wheel. In particular, the lever can be made in one piece with built-in pallets.

FIG. 1 shows a Swiss lever escapement in a standard 20-tooth configuration, which serves as a basis for comparison. Its parameters correspond to reference 3 in table 2.

For the configuration of FIG. 5, the model used to calculate the values noted in table 2 suggests that an increase in the efficiency of around 10% for the Ni version, and around 11% for the lighter-weight Si version, could be achieved.

For the validation tests, the absolute value of the efficiency is difficult to predict because it depends directly on the value of the efficiency of transmission between the escape wheel and the fourth wheel, which is difficult to estimate. Instead, therefore, comparisons of the amplitude obtained are made between a standard configuration and an optimized escapement.

The following table 1 shows the measured amplitudes obtained from the two configurations and the control escapement (a standard Swiss lever with an escape wheel made of Ni). The amplitudes given below are averages taken from at least five pieces, the standard deviation of these averages being typically 5°.

TABLE 1

| | Ref. no. from table 2 | Measured amplitude [°] |
|---|---|---|
| Control escapement | 3 | 275 |
| Si wheel | 2 | 307 |
| Ni wheel | 2 | 310 |

TABLE 2

| Ref. | Pallet width Lpl [%] | Efficiency η [%] | Length of impulse plane of pallet La | Ratio of impulse plane lengths Lg/La | Pallet angle Ls, Le [°] | Ratio of angles Ls/d | Number of teeth |
|---|---|---|---|---|---|---|---|
| 1 | 38.2 | 54.4% | 157 | 1.78 | 3.3 | 0.62 | 20 teeth |
| 2 | 38.8 | 54.8% | 158 | 1.72 | 2.8 | 0.63 | 24 teeth |
| 3 | 72.3 | 45.2% | 290 | 0.40 | 6.3 | 2.6 | 20 teeth |

The study shows that in the Swiss lever escapement forming the subject of the invention, the relative width Lpl of each of the pallets is advantageously ≦45%. The ratio of the length of arc Ls, Le of either the exit or entry pallet to the length of arc d of one of the escape wheel teeth is preferably less than 1:1. The length of the impulse plane La of one of said pallets is advantageously less than 200 μm. The ratio of the length of the impulse plane Lg of one of the escape wheel teeth to the length of the impulse plane La of one of the pallets is preferably greater than 1.5:1.

The invention claimed is:

1. A Swiss lever escapement comprising:

an escape wheel having teeth, and a lever, wherein the lever comprises (i) an entry pallet and an exit pallet that engage alternately with the teeth of the escape wheel, and (ii) a fork that engages periodically with an impulse pin on a roller mounted on the staff of a regulator balance wheel, wherein the relative width Lpl of each of said pallets, expressed as a percentage of the sum of the lengths of arc of one of said teeth and one of said pallets, measured at the circumference of the escape wheel, is:

$$Lpl = \left(\frac{Ls}{Ls+d} \text{ or } \frac{Le}{Le+d}\right) \leq 60\%$$

where Ls and Le are the lengths of arc of the exit pallet and entry pallet, respectively, and d is the length of arc of one escape wheel tooth.

2. The escapement as claimed in claim 1, in which said relative width Lpl of each of said pallets is ≦45%.

3. The escapement as claimed in claim 2, in which the ratio of the length of arc Ls, Le of the exit or entry pallet, respectively, to the length of arc d of one of the escape wheel teeth is less than 1:1.

4. The escapement as claimed in claim 3, in which the length of the impulse plane La of one of said pallets is less than 200 μm.

5. The escapement as claimed in claim 3, in which the ratio of the length of the impulse plane Lg of one of said teeth to the length of the impulse plane La of one of the pallets is more than 1.5:1.

6. The escapement as claimed in claim 3, in which the ratio of the lift angle of the balance wheel to the lift angle of the lever is from 3.7:1 to 7:1.

7. The escapement as claimed in claim 2, in which the length of the impulse plane La of one of said pallets is less than 200 μm.

8. The escapement as claimed in claim 2, in which the ratio of the length of the impulse plane Lg of one of said teeth to the length of the impulse plane La of one of the pallets is more than 1.5:1.

9. The escapement as claimed in claim 2, in which the ratio of the lift angle of the balance wheel to the lift angle of the lever is from 3.7:1 to 7:1.

10. The escapement as claimed in claim 1, in which the ratio of the length of arc Ls, Le of the exit or entry pallet, respectively, to the length of arc d of one of the escape wheel teeth is less than 1:1.

11. The escapement as claimed in claim 10, in which the length of the impulse plane La of one of said pallets is less than 200 μm.

12. The escapement as claimed in claim 10, in which the ratio of the length of the impulse plane Lg of one of said teeth to the length of the impulse plane La of one of the pallets is more than 1.5:1.

13. The escapement as claimed in claim 10, in which the ratio of the lift angle of the balance wheel to the lift angle of the lever is from 3.7:1 to 7:1.

14. The escapement as claimed in claim 1, in which the length of the impulse plane La of one of said pallets is less than 200 μm.

15. The escapement as claimed in claim 14, in which the ratio of the length of the impulse plane Lg of one of said teeth to the length of the impulse plane La of one of the pallets is more than 1.5:1.

16. The escapement as claimed in claim 14, in which the ratio of the lift angle of the balance wheel to the lift angle of the lever is from 3.7:1 to 7:1.

17. The escapement as claimed in claim 1, in which the ratio of the length of the impulse plane Lg of one of said teeth to the length of the impulse plane La of one of the pallets is more than 1.5:1.

18. The escapement as claimed in claim 17, in which the ratio of the lift angle of the balance wheel to the lift angle of the lever is from 3.7:1 to 7:1.

19. The escapement as claimed in claim 1, in which the ratio of the lift angle of the balance wheel to the lift angle of the lever is from 3.7:1 to 7:1.

20. The escapement as claimed in claim 19, in which the ratio of the lift angle of the balance wheel to the lift angle of the lever is 4.5:1.

* * * * *